US007247002B2

(12) United States Patent
Albrecht et al.

(10) Patent No.: US 7,247,002 B2
(45) Date of Patent: Jul. 24, 2007

(54) LAMELLATE CMC STRUCTURE WITH INTERLOCK TO METALLIC SUPPORT STRUCTURE

(75) Inventors: Harry A. Albrecht, Hobe Sound, FL (US); Yevgeniy Shteyman, West Palm Beach, FL (US); Jay A. Morrison, Oviedo, FL (US); Daniel G. Thompson, Plum Borough, PA (US)

(73) Assignee: Siemens Power Generation, Inc., Orlando, FL (US)

( * ) Notice: Subject to any disclaimer, the term of this patent is extended or adjusted under 35 U.S.C. 154(b) by 0 days.

(21) Appl. No.: 11/169,477

(22) Filed: Jun. 29, 2005

(65) Prior Publication Data

US 2007/0020105 A1 Jan. 25, 2007

Related U.S. Application Data

(63) Continuation-in-part of application No. 11/002,028, filed on Dec. 2, 2004, now Pat. No. 7,153,096.

(51) Int. Cl.
*F01D 9/00* (2006.01)

(52) U.S. Cl. ..... 416/224; 416/97 A; 416/229 A; 416/229 R; 415/200

(58) Field of Classification Search ..... 415/200; 416/95, 97 A, 224, 229 A, 229 R
See application file for complete search history.

(56) References Cited

U.S. PATENT DOCUMENTS 3,301,526 A 1/1967 Chamberlain
3,378,228 A 4/1968 Davies et al.
3,515,499 A 6/1970 Beer et al.
3,619,077 A 11/1971 Wile et al.
3,778,183 A 12/1973 Luscher et al.
3,872,563 A 3/1975 Brown et al.
4,042,162 A 8/1977 Meginnis et al.
4,051,289 A 9/1977 Adamson
4,221,539 A 9/1980 Corrigan
4,260,326 A 4/1981 Scott et al.
4,314,794 A 2/1982 Holden et al.
4,472,866 A 9/1984 Moracz et al.
4,573,872 A * 3/1986 Nakata ..... 416/96 A
4,583,274 A 4/1986 Moracz et al.
4,594,053 A * 6/1986 Sohngen ..... 415/200
5,064,727 A * 11/1991 Naik et al. ..... 415/173.4
5,074,753 A 12/1991 Covington et al.
5,222,297 A 6/1993 Graff et al.
5,236,151 A * 8/1993 Hagle et al. ..... 244/117 A
5,269,658 A 12/1993 Carlson et al.

(Continued)

*Primary Examiner*—Igor Kershteyn

(57) ABSTRACT

A component (10) for a gas turbine engine formed of a stacked plurality of ceramic matrix composite (CMC) lamellae (12) supported by a metal support structure (20). Individual lamellae are supported directly by the support structure via cooperating interlock features (30, 32) formed on the lamella and on the support structure respectively. Mating load-transferring surfaces (34, 36) of the interlock features are disposed in a plane (44) oblique to local axes of thermal growth (38, 40) in order to accommodate differential thermal expansion there between with delta alpha zero expansion (DAZE). Reinforcing fibers (62) within the CMC material may be oriented in a direction optimized to resist forces being transferred through the interlock features. Individual lamellae may all have the same structure or different interlock feature shapes and/or locations may be used in different groups of the lamellae. Applications for this invention include an airfoil assembly (10) and a ring segment assembly (82).

29 Claims, 3 Drawing Sheets

U.S. PATENT DOCUMENTS 5,279,892 A 1/1994 Baldwin et al.
5,314,309 A 5/1994 Blakeley et al.
5,439,353 A 8/1995 Cook et al.
5,640,767 A 6/1997 Jackson et al.
5,806,796 A 9/1998 Healey
6,013,592 A 1/2000 Merrill et al.
6,197,424 B1 3/2001 Morrison et al.
6,322,322 B1 11/2001 Rhodes et al.
6,451,416 B1 9/2002 Holowczak et al.
6,457,939 B2 * 10/2002 Ghasripoor et al. ..... 415/174.4
6,464,456 B2 10/2002 Darolia et al.
6,514,046 B1 2/2003 Morrison et al.
6,689,246 B2 2/2004 Hirahara et al.
6,696,144 B2 2/2004 Holowczak et al.
6,709,230 B2 3/2004 Morrison et al.

* cited by examiner

LAMELLATE CMC STRUCTURE WITH INTERLOCK TO METALLIC SUPPORT STRUCTURE

This application is a continuation-in-part and claims benefit of the Dec. 2, 2004, filing date of U.S. application Ser. No. 11/002,028 now U.S. Pat. No. 7,153,096, which is incorporated by reference herein.

FIELD OF THE INVENTION

This invention relates generally to the field of gas turbine engines, and more particularly to a gas turbine engine component formed of a stacked plurality of ceramic matrix composite (CMC) lamellae.

BACKGROUND OF THE INVENTION

Stacked lamellate construction is a known art for forming gas turbine engine parts. U.S. Pat. No. 3,378,228 describes an airfoil for a gas turbine that is formed of a stack of laminar sections of monolithic ceramic material. The stack is held together in compression by a metal tie bolt. U.S. Pat. No. 4,260,326 describes a similar arrangement that is further improved by a piston and cylinder arrangement that accommodates differential thermal expansion between the ceramic stack and the metal supporting structure.

BRIEF DESCRIPTION OF THE DRAWINGS

The invention is explained in the following description in view of the drawings that show.

DETAILED DESCRIPTION OF THE INVENTION

Figure 1:
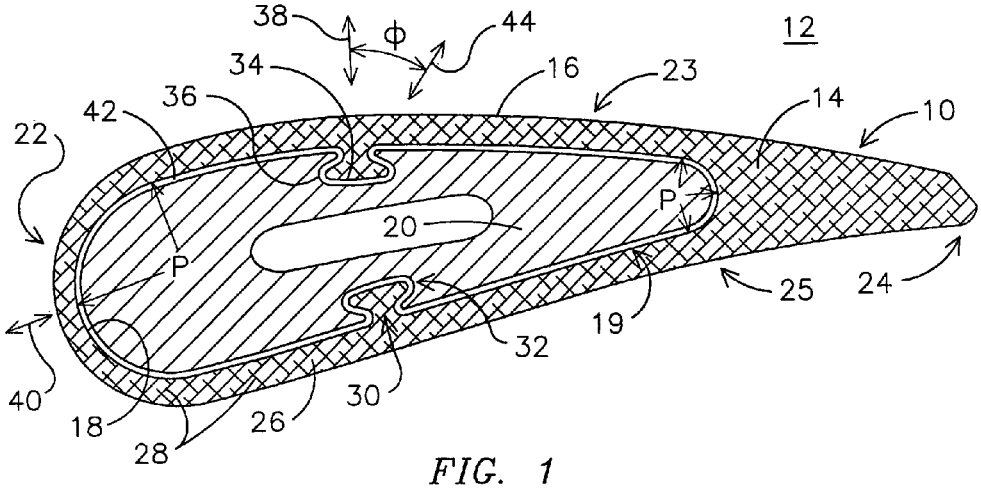
FIG. 1 is a cross-sectional view of a first embodiment of an airfoil assembly of a gas turbine engine formed of a stacked plurality of CMC lamellae supported by a metal support structure.

FIG. 1 is a cross-sectional view of an airfoil assembly 10 which functions as a stationary vane of a gas (combustion) turbine engine 12. The assembly 10 includes a lamellate stack formed of a plurality of lamellae 14, only one of which is illustrated in the cross-sectional view of FIG. 1. Each lamella 12 has an outer peripheral surface 16 collectively defining an airfoil shape exposed to a hot combustion gas flow in the gas turbine engine 12 and an inner peripheral surface 18 defining an opening and collectively defining a core 19. Disposed in the opening 18 is a support structure 20 which may typically be made of a metallic material, but may be made of a composite or other appropriately strong material. The support structure 20 ties the stacked lamellae 14 to the engine frame (not shown). The airfoil assembly 10 has a leading edge portion 22 and a trailing edge 24 portion. The individual lamella 14 of the assembly 10 may be substantially identical to each other; however, one or more lamella 14 may be different from the other lamellae 14 in the assembly 10, as will be described further herein. The term airfoil-shaped is intended to refer to the general shape of an airfoil cross-section, however, embodiments of the invention are not limited to any particular shape or to any specific airfoil shape. Each lamella 14 of the assembly 10 of FIG. 1 is substantially flat, such as in the form of a flat plate, although other embodiments may utilize curved lamellae or lamellae having non-planar abutting surfaces. To facilitate discussion, each lamella 14 has an in-plane direction parallel to the plane of the paper of FIG. 1 and a through thickness direction perpendicular to the plane of the paper of FIG. 1. A chord line can be defined as a straight line extending from the leading edge 22 to the trailing edge 24 of the airfoil shaped lamella 14.

The assembly 10 will be acted upon by a variety of forces during operation of the gas turbine engine 12. Working gas flowing over the airfoil shape 16 will create lift forces and bending moments across the airfoil. Cooling air passing through the opening 18 at a pressure higher than the pressure of the working gas will create internal pressure forces P acting upon the inner peripheral surfaces 18 to cause a ballooning of the lamellae 14. Temperature transients, differences in steady state temperatures and differences between the coefficients of thermal expansion of the lamellae 14 and the support structure 20 will generate differential thermal growth within the assembly 10. To accommodate such movement while simultaneously resisting such forces, the lamella 14 is provided with an interlock feature 30 cooperatively interfaced with a respective interlock feature 32 of the support structure 20. The cooperating interlock features 30, 32 are effective to interconnect the support structure 20 and the lamellae 14 in order to transmit forces from the lamella 14 to the engine frame through the support structure 20, while at the same time accommodating differential thermal growth between the lamella 14 and the support structure 20. The interlock features 30, 32 comprise respective opposed, contacting, load-carrying surfaces 34, 36. In the embodiment of FIG. 1, these surfaces 34, 36 are disposed generally in planes oblique to local axes of differential thermal growth. As a result of the cooling air ballooning forces and the relatively higher temperature of the lamella 14 compared to that of the support structure 20, the opening 18 of assembly 10 may tend to grow in size and to expand outwardly away from the support structure 20 along axes of growth 38, 40 during operation of gas turbine engine 12. As a result, gap 42 existing between various opposed portions of the respective structures may become larger as the engine 12 progresses from cold shutdown conditions to hot operating conditions. However, opposed, load carrying surfaces 34, 36 will remain in contact along an axis of contact 44 to support the lamella 14 during such differential growth. The angle of the axis of contact 44 relative to the axes of growth 38, 40 may be selected to achieve delta alpha zero expansion (DAZE), whereby a difference in the amount of growth along axis 38 compared to the amount of growth along axis 40 is accommodated by the angle of the contact along the axis of contact 44 relative to the axes of growth 38, 40. For a typical gas turbine airfoil application utilizing oxide-oxide CMC lamellae and a metal alloy support structure, the DAZE angle $\phi$ may be in the range of about 30° to about 60°.

Figure 2:
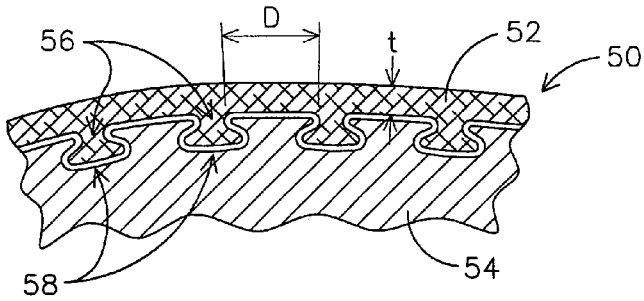
FIG. 2 is a partial cross-sectional view of a second embodiment of an airfoil assembly formed of a stacked plurality of CMC lamellae supported by a metal support structure.

FIG. 2 is a partial cross-sectional view of another embodiment of an airfoil assembly 50 wherein stacked lamellae 52 (one shown) are supported by a support structure 54. In this embodiment, multiple cooperating interlock features 56, 58 are disposed along a single side of the airfoil, as differentiated from the airfoil assembly 10 of FIG. 1 wherein a single set of cooperating interlock features 30, 32 are disposed along each side of the airfoil assembly 10. One may appreciate that as the distance D between adjacent interlock features 56 is decreased, the peak stress level in the material of the lamella 52 will be reduced, with other variables held constant. It may be desired to maintain the thickness t below a particular value in order to facilitate the cooling of the material and to minimize thermal stresses within the material. For typical CMC materials used in gas turbine engine applications, the ratio (D/t) of the distance (D) between adjacent features to the thickness (t) of the unsupported material between the interlock features may be desired to be less than 1.4, or less than 1.0, or less than 0.5, and/or anywhere in the range of 0.4 to 1.4 in various embodiments. Application-specific values will depend upon the strength of the material, the specific component geometry, the magnitude of forces involved, and other design variables and rules. In the undesirable event of mechanical failure of a portion of the lamella 52, such as may result from impact damage, one may appreciate that the presence of the multiple interlock features would function to limit the size of the portion of the lamella 52 that might fail, since undamaged interlock features adjacent to a damaged area would maintain support to the surrounding portions of the lamella. For airfoil applications, it may be unnecessary to use an interlock feature along the leading edge portion 22 and/or the trailing edge portion 24 when both the suction side 23 and pressure side 25 of the lamellae are supported by respective cooperating interlock features.

The lamellae 14, 52 may be made of a ceramic matrix composite (CMC) material. A CMC material includes a ceramic matrix material 26 that hosts a plurality of reinforcing fibers 28. The CMC material may be anisotropic, at least in the sense that it can have different strength characteristics in different directions. Various factors, including material selection and fiber orientation, can affect the strength characteristics of a CMC material. The lamella 14, 52 can be made of a variety of materials, and embodiments of the invention are not limited to any specific materials. In one embodiment, the matrix material 26 may be alumina, and the fibers 28 may be an aluminosilicate composition consisting of approximately 70% Alumina and 28% Silica with 2% Boron (sold under the name NEXTEL™ 312). The fibers 28 can be provided in various forms, such as a woven fabric, blankets, unidirectional tapes, and mats. A variety of techniques are known in the art for making a CMC material.

Fiber material is not the sole determinant of the strength properties of a CMC material. Fiber direction can also affect the strength. In a CMC lamella 14 according to embodiments of the invention, the fibers 28 can be arranged to provide the assembly 10 with anisotropic strength properties. More specifically, the fibers 28 can be oriented in the lamella 14 to provide strength or strain tolerance in the direction of high stresses or strains. To that end, substantially all of the fibers 28 can be provided in the in-plane direction of the lamella 14; however, a CMC material according to embodiments of the invention can have some fibers 28 in the through thickness direction as well. "Substantially all" is intended to mean all of the fibers 28 or a sufficient majority of the fibers 28 so that the desired strength properties are obtained.

Figure 3:
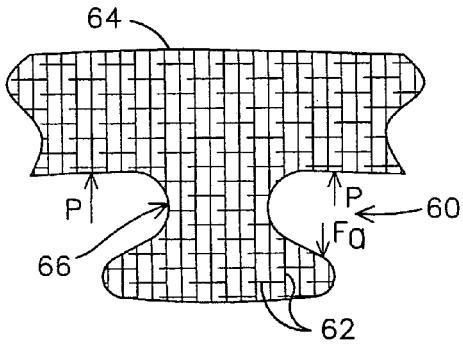
FIGS. 3 and 4 are cross-sectional views of two CMC lamellae illustrating two different fiber orientations relative to an interlock feature.
Figure 4:
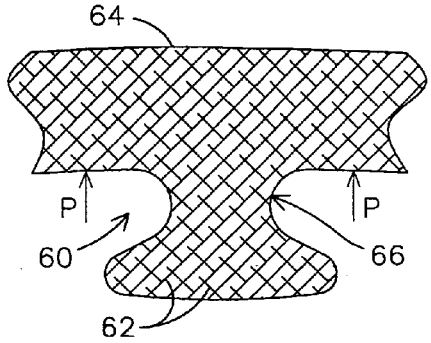

The planar direction fibers 28 of the CMC lamella 14 can be substantially unidirectional, substantially bi-directional or multi-directional. In a bi-directional lamella, one portion of the fibers can extend at one angle relative to the chord line and another portion of the fibers can extend at a different angle relative to the chord line such that the fibers cross. The crossing fibers may be oriented at about 90 degrees relative to each other, but other relative orientations are possible, such as at about 30, 45 or 60 degrees. FIGS. 3 and 4 illustrate two different embodiments of a CMC lamella interlock feature 60 with 90° bi-directional fibers 62 oriented in two different orientations. FIG. 3 illustrates the fibers 62 being oriented essentially parallel to and perpendicular with a surface 64 exposed to a hot working gas flow, i.e., parallel to and perpendicular to a chord line (not shown). FIG. 4 illustrates the fibers 62 being oriented transverse to the surface 64 (chord line) at approximately a 45° angle, although other angles are contemplated within the scope of the present invention. Note that in both of these embodiments, the fibers 62 are disposed in directions that place the fibers in tension when carrying loads resulting from internal pressure force P. The in-plane orientation of fibers 62 is preferred for carrying in-plane moment loads through the neck region 66 of the interlock features 60 when compared to through-thickness oriented fibers (i.e. perpendicular to the plane of FIGS. 3 and 4).

One particular CMC lamella 14 according to embodiments of the invention can have an in-plane tensile strength from about 150 megapascals (MPa) to about 200 MPa in the fiber direction and, more specifically, from about 160 MPa to about 184 MPa in the fiber direction. Further, such a lamella 14 can have an in-plane compressive strength from about 140 MPa to 160 MPa in the fiber direction and, more specifically, from about 147 MPa to about 152 MPa in the fiber direction. This particular CMC lamella 14 can be relatively weak in tension in the through thickness direction. For example, the through thickness tensile strength can be from about 3 MPa to about 10 MPa and, more particularly, from about 5 MPa to about 6 MPa, which is substantially lower than the in-plane tensile strengths discussed above. However, the lamella 14 can be relatively strong in compression in the through thickness direction. For example, the through thickness compressive strength of a lamella 14 according to embodiments of the invention can be from about −251 MPa to about −314 MPa. These strength values can be affected by temperature. Again, the above values are provided merely as examples, and embodiments of the invention are not limited to any specific strength in the in-plane or through thickness directions.

With this understanding, the plurality of lamella 14 can be substantially radially stacked in the thru-thickness direction to form the airfoil assembly 10 according to embodiments of the invention. The outer peripheral surface 16 of the stacked lamellae 14 can form the exterior airfoil shape of the assembly 10. A further coating (not shown) may be applied to the outer peripheral surface 16 to function as an environmental and/or thermal barrier coating. Once such coating is described in U.S. Pat. No. 6,197,424, owned by the assignee of the present invention and incorporated by reference herein.

Figure 5:
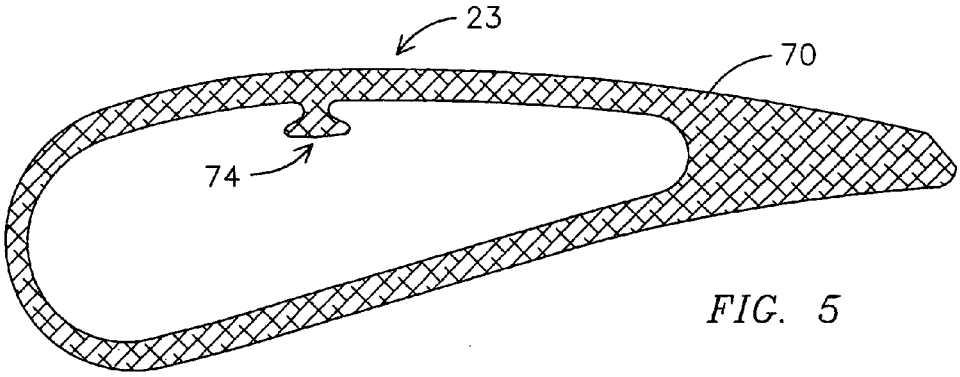
FIGS. 5 and 6 are plan views of two CMC lamellae illustrating an interlock feature in two different locations.
Figure 6:
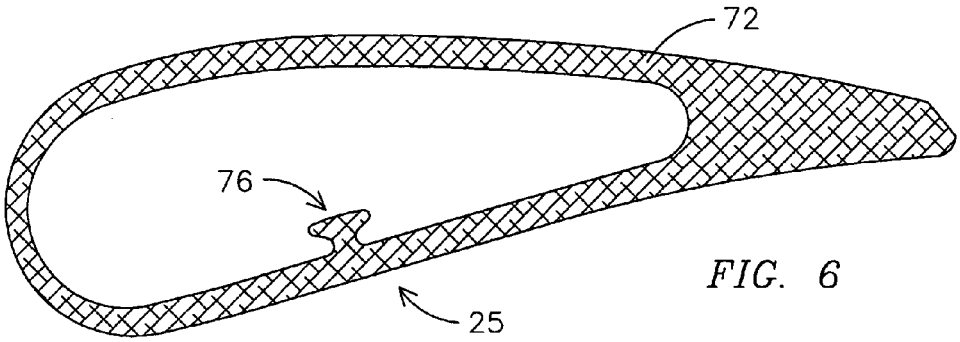

The individual lamella of an assembly can be substantially identical to each other. Alternatively, one or more lamella can be different from the other lamellae in a variety of ways including, for example, thickness, size, and/or shape. FIGS. 5 and 6 illustrate alternatively shaped lamellae 70, 72 that may be used in airfoil assembly 10. Lamella 70 includes an interlock feature 74 that is formed to cooperate with an interlock feature 32 formed on a suction side 23 of the metal support structure 20. In contrast, lamella 72 includes an interlock feature 76 that is formed to cooperate with an interlock feature 32 formed on a pressure side 25 of support structure 20. Any number of lamellae 70, 72 may be grouped together or interspersed with other shaped lamellae to form the stack defining the airfoil assembly 10. The lamellae 70, 72 of FIGS. 5 and 6 may have a lower thermal mass than lamella 14 of FIG. 1, thereby facilitating a more even temperature distribution across the structure. In other embodiments, the interlock features of a first group of lamellae may be displaced in a chord-wise direction relative to the interlock features of a second group of lamellae.

Figure 7:
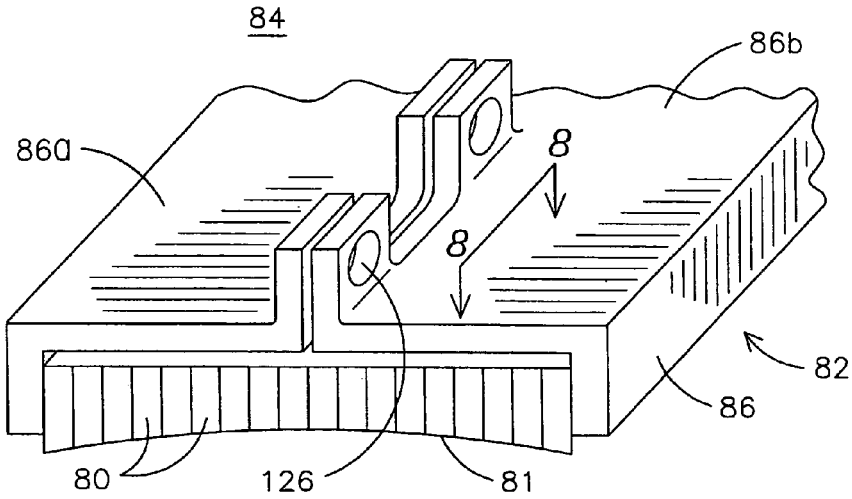
FIG. 7 is a plan view of a gas turbine ring segment formed of a stacked plurality of CMC lamellae supported by a metal carrier.
Figure 8:
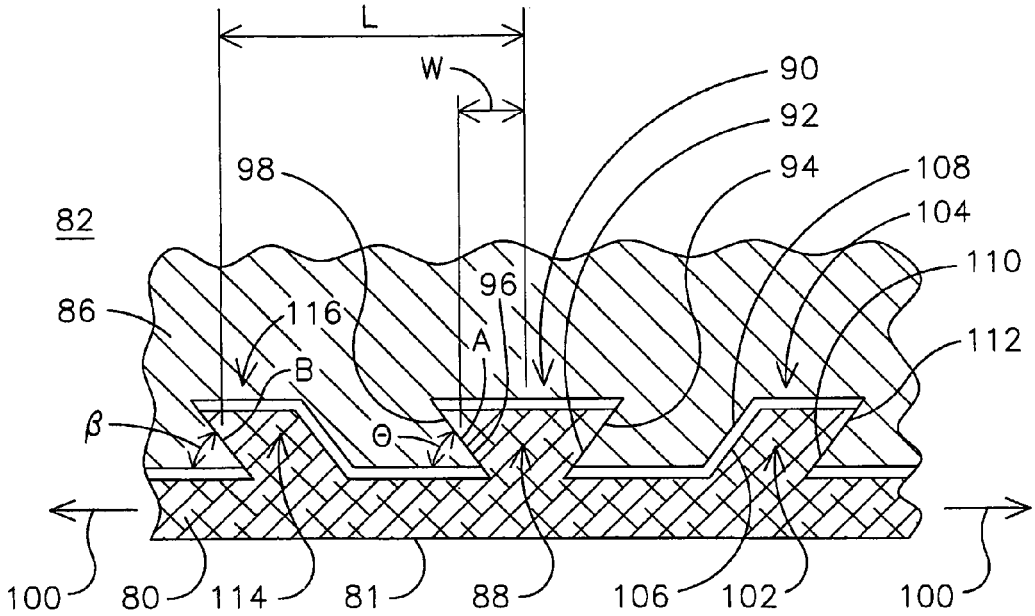
FIG. 8 is a partial cross-sectional view of the ring segment of FIG. 7 illustrating interlock features between one of the lamellae and the carrier.

FIG. 7 illustrates an embodiment of the invention wherein a stacked plurality of lamellae 80 forms part of a ring segment assembly 82 of a gas turbine engine 84. FIG. 8 is a partial cross-sectional view of the ring segment assembly 82 as viewed at section 8—8 of FIG. 7, illustrating embodiments of interlock features used to interconnect CMC lamellae 80 with a metallic carrier 86. The lamellar stack 80 presents a wear surface 81 for rotating blade tips (not shown) of the gas turbine engine 84 while at the same time protecting the metallic carrier 86 from the hot combustion gas flow. First cooperating interlock features 88, 90 are formed at a first location of the lamella 80 and carrier 86 respectively. These interlock features 88, 90 include two opposed pairs of mating surfaces 92, 94 and 96, 98, with each pair disposed at different angles with respect to an axis of thermal growth 100 and at an angle oblique to each other. Second cooperating interlock features 102, 104 are formed at a second location of the lamella 80 and carrier 86 respectively. Interlock features 102, 104 include opposed pairs of mating surfaces 106, 108 and 110, 112, with each pair disposed at the same angle with respect to the axis of growth 100 and parallel to each other. Third cooperating interlock features 114, 116 are formed at a third location of the lamella 80 and carrier 86 respectively. The third interlock features 114, 116 are mirror images of second interlock features 102, 104, although the invention is not limited to such symmetry.

It may be beneficial to design the ring segment assembly 82 so that thermal growth along the major axis of growth 100 does not result in the bending of the CMC material. The thermal growth along axis 100 (hereinafter referred to as horizontal) will be zero at some point along the component, for example the center of interlock features 88, 90 in the illustrated embodiment of FIG. 8. Distances along the axis of growth 100 from that point to respective centers of mating surfaces (points A and B) are labeled as W and L in FIG. 8. Bending of the CMC material will be prevented when the movement in a direction perpendicular to the axis of growth 100 (hereinafter referred to as vertical) is equal at various points (such as points A and B) remote from the point of zero thermal growth. The vertical movement of point A will be equal to the horizontal growth ($\Delta W$) times the tan $\theta$. The vertical movement of point B will be equal to the horizontal growth ($\Delta L$) times the tan $\beta$. The values of vertical movement will be equal at points A and B for any given change in temperature when $$\frac{\tan\beta}{\tan\theta} = \frac{L}{W}.$$

Figure 9:
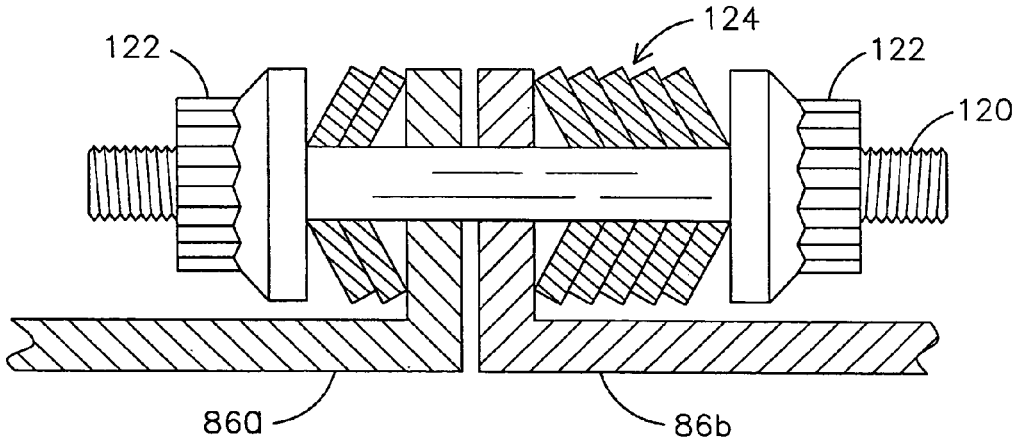
FIG. 9 is a partial cross-sectional view of the ring segment of FIG. 7 illustrating a tie bolt arrangement.

The plurality of laminates of the present invention can be held together in various manners. FIG. 9 illustrates how the two halves 86*a*, 86*b* of carrier 86 are held together by a tie bolt 120 and opposed nuts 122 held in tension by a number of Bellville or conical washers 122 to apply a compressive load to the stack of lamellae 80. The tie bolt 120 is installed through aligned holes 126 which are illustrated in FIG. 7 without the bolt 120. In addition or apart from using fasteners, at least some of the individual lamella can also be bonded to each other. Such bonding can be accomplished by sintering the adjacent lamellae together or by the application of a bonding material such as an adhesive. In one embodiment, the lamellae may be stacked and pressed together when heated, causing adjacent lamellae to sinter together. Alternatively, a ceramic powder can be mixed with a liquid to form a slurry. The slurry can be applied between the lamellae in the stack. When exposed to high temperatures, the slurry itself can become a ceramic, thereby bonding the lamellae together. In addition to sintering and bonding, the lamellae can be joined together through co-processing of partially processed individual lamella using such methods as chemical vapor infiltration (CVI), slurry or sol-gel impregnation, polymer precursor infiltration & pyrolysis (PIP), melt-infiltration, etc. In these cases, partially densified individual lamellae are formed, stacked, and then fully densified and/or fired as an assembly, thus forming a continuous matrix material phase in and between the lamellae.

Advantageously in certain embodiments, the individual lamellae need not be affixed to adjacent lamellae, but rather are supported primarily or only by the interlock features. Such embodiments are especially useful when there is no need to provide an air seal between adjacent lamellae.

The CMC lamellae according to embodiments of the invention can be made in a variety of ways. The CMC material may be provided initially in the form of a substantially flat plate, with the direction of the fibers within the plate being selected to optimize the performance of the end product. Water jet or laser cutting may be used to cut one or more lamellae from a single flat plate. Flat plate CMC can provide numerous advantages. At the present, flat plate CMC provides one of the strongest, most reliable and statistically consistent forms of the material. As a result, the design can avoid manufacturing difficulties that have arisen when fabricating tightly curved configurations. For example, flat plates are unconstrained during curing and thus do not suffer from anisotropic shrinkage strains. The assembly of the laminates in a stack may occur after each laminate is fully cured so as to avoid shrinkage issues. Flat, thin CMC plates also facilitate conventional non-destructive inspection. Furthermore, the method of construction reduces the criticality of delamination-type flaws, which are difficult to find. Moreover, dimensional control is more easily achieved as flat plates can be accurately formed and machined to shape using cost-effective cutting methods. A flat plate construction also enables scaleable and automated manufacture.

One or more lamellae according to embodiments of the invention can include a number of features to facilitate bonding of a material to the outer peripheral surface 16. For example, the outer peripheral surface 16 can have a rough finish after it is cut from a flat plate. Further, the laminates can be stacked in a staggered or offset manner or cut to slightly different sizes to create an uneven outer peripheral surface 16. Alternatively, or in addition to the above, the outer peripheral surface 16 can be tapered, such as by applying the cutting tool at an angle when the lamella is cut from a flat plate. The outer peripheral surface 16 may include one or more recesses and/or cutouts such as dovetail cutouts.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A component for a gas turbine engine comprising:

a lamellate stack, each lamella of the stack comprising a first surface exposed to a hot combustion gas flow and a second surface comprising an interlock feature; and a support structure comprising at least one interlock feature cooperating with each respective lamella interlock feature to transmit forces between respective opposed mating surfaces to support the lamellae while accommodating differential thermal expansion between the support structure and the lamellate stack.

2. The component of claim 1, wherein each lamella comprises a flat plate of ceramic matrix composite material comprising fibers disposed in an in-plane direction of the lamella, at least a portion of the fibers being disposed in a direction that places the portion of fibers in tension when carrying loads resulting from a pressure force applied against the second surface.

3. The component of claim 1, further comprising:

a first lamella interlock feature cooperating with a first support structure interlock feature along respective first mating surfaces disposed at a first angle θ relative to an axis of thermal growth; and a second lamella interlock feature cooperating with a second support structure interlock feature along respective second mating surfaces disposed at a second angle β different than the first angle θ relative to the axis of thermal growth.

4. The component of claim 3, further comprising:

a center of the first mating surfaces disposed at a distance W from a point of zero relative thermal growth along the axis of thermal growth;

a center of the second mating surfaces disposed at a distance L from a point of zero relative thermal growth along the axis of thermal growth; and $$\frac{\tan\beta}{\tan\theta} = \frac{L}{W}.$$

5. A gas turbine engine comprising the component of claim 1.

6. An airfoil assembly comprising:

a stacked plurality of lamellae, each lamella comprising an outer surface collectively defining an airfoil shape, and each lamella comprising an inner surface collectively defining a core;

a support structure disposed in the core and comprising at least one interlock feature;

each lamella comprising an interlock feature cooperatively interfaced with a respective support structure interlock feature, the cooperating interlock features effective to transmit forces there between to support the lamellae relative to the support structure while accommodating differential thermal expansion there between.

7. The airfoil assembly of claim 6, further comprising an interlock feature formed on a pressure side of the support structure cooperatively interfaced with an interlock feature formed on a pressure side of each lamella.

8. The airfoil assembly of claim 6, further comprising an interlock feature formed on a suction side of the support structure cooperatively interfaced with an interlock feature formed on a suction side of each lamella.

9. The airfoil assembly of claim 6, further comprising:

an interlock feature formed on a pressure side of the support structure cooperatively interfaced with an interlock feature formed on a pressure side of each lamella; and an interlock feature formed on a suction side of the support structure cooperatively interfaced with an interlock feature formed on a suction side of each lamella.

10. The airfoil assembly of claim 6, further comprising:

a first number of the lamellae each comprising an interlock feature formed at a first location cooperatively interfaced with a first support structure interlock feature; and a second number of the lamellae each comprising an interlock feature formed at a second location different than the first location cooperatively interfaced with a second support structure interlock feature.

11. The airfoil assembly of claim 6, further comprising:

an interlock feature formed on a pressure side of the support structure cooperatively interfaced with an interlock feature formed on a pressure side of a first number of the lamella; and an interlock feature formed on a suction side of the support structure cooperatively interfaced with an interlock feature formed on a suction side of a second number of the lamella.

12. The airfoil assembly of claim 11, wherein ones of the first number of the lamella are interspersed between ones of the second number of the lamella.

13. The airfoil assembly of claim 6, wherein adjacent lamellae are bonded together.

14. The airfoil assembly of claim 6, wherein each lamella comprises a plurality of interlock features disposed along the inner surface and cooperatively interfaced with respective ones of a plurality of support structure interlock features.

15. The airfoil assembly of claim 14, wherein a ratio (D/t) of a distance (D) between adjacent interlock features to a thickness (t) of unsupported material between the interlock features is less than 1.4.

16. The airfoil assembly of claim 14, wherein a ratio (D/t) of a distance (D) between adjacent interlock features to a thickness (t) of unsupported material between the interlock features is in a range of 0.4 to 1.4.

17. The airfoil assembly of claim 6, further comprising the interlock feature of each of a first group of the plurality of lamellae being geometrically different than the interlock feature of each of a second group of the plurality of lamella.

18. The airfoil assembly of claim 6, wherein the cooperating interlock features comprise respective mating surfaces disposed along an axis of contact oblique to a local axis of thermal growth.

19. The airfoil assembly of claim 18, wherein the axis of contact is disposed at an angle with respect to the axis of thermal growth that is selected to achieve delta alpha zero expansion.

20. The airfoil assembly of claim 6, wherein the cooperating interlock features comprise a first pair of respective mating surfaces disposed along a first axis of contact oblique to a local axis of thermal growth and a second pair of respective mating surfaces disposed along a second axis of contact oblique to the first axis of contact.

21. The airfoil assembly of claim 6, wherein the cooperating interlock features comprise a first pair of respective mating surfaces disposed along a first axis of contact oblique to a local axis of thermal growth and a second pair of respective mating surfaces disposed along a second axis of contact parallel to the first axis of contact.

22. The airfoil assembly of claim 6, wherein the respective interlock features of a first group of the lamellae are displaced in a chord-wise direction relative to the interlock features of a second group of the lamellae.

23. The airfoil assembly of claim 6, wherein each lamella comprises a flat plate of ceramic matrix composite material comprising fibers disposed in an in-plane direction of the lamella, at least a portion of the fibers being disposed in a direction that places the portion of fibers in tension when carrying loads resulting from a pressure force applied against the inner surface.

24. A gas turbine engine comprising the airfoil assembly of claim 6.

25. A ring segment assembly for a gas turbine engine comprising:

a first carrier portion comprising an interlock feature;

a second carrier portion removably attached to the first carrier portion and comprising an interlock feature;

a stacked plurality of lamellae each comprising a wear surface and an opposed surface defining an interlock feature cooperatively interfaced with the interlock feature of at least one of the first carrier portion and the second carrier portion, the cooperating interlock features effective to support the stacked lamellae relative to the attached carrier portions while accommodating differential thermal growth there between.

26. The ring segment assembly of claim 25, further comprising mating load-transferring surfaces of the cooperating interlock features being disposed in a plane oblique to a local axis of thermal growth.

27. The ring segment assembly of claim 25, further comprising:

a plurality of interface features formed on each lamella cooperatively interfaced with a respective plurality of interface features formed on the respective one of the first and second carrier portions; and mating load transferring surfaces of the respective cooperating interlock features being disposed in a respective plane that is oblique to a local axis of growth by an angle that varies as a function of a distance of a center of the respective mating load transferring surfaces from a point of zero relative thermal growth along the axis of thermal growth.

28. The ring segment assembly of claim 27, further comprising:

a first pair of mating load transferring surfaces disposed at a distance W from the point of zero relative thermal growth being disposed at an angle θ relative to the local axis of thermal growth;

a second pair of mating load transferring surfaces disposed at a distance L from the point of zero relative thermal growth being disposed at an angle β relative to the local axis of thermal growth; and $$\frac{\tan\beta}{\tan\theta} = \frac{L}{W}.$$

29. A gas turbine engine comprising the ring segment assembly of claim 25.

* * * * *